US005709310A

United States Patent [19]

Kretz

[11] Patent Number: 5,709,310

[45] Date of Patent: Jan. 20, 1998

[54] DEVICE FOR OPENING A RECEPTACLE HAVING A RIM CLOSED BY A CAPSULE

[75] Inventor: Laurent Kretz, Selestat, France

[73] Assignee: Societe Alsacienne d'Aluminium, Saint Julien en Genevois, France

[21] Appl. No.: 801,957

[22] Filed: Feb. 18, 1997

[30] Foreign Application Priority Data

Feb. 19, 1996 [FR] France ..... 96 02011

[51] Int. Cl.[6] ..... B65D 17/34

[52] U.S. Cl. ..... 220/270; 220/276; 220/359; 215/232; 215/347

[58] Field of Search ..... 220/270, 276, 220/359; 215/232, 256, 347, 349

[56] References Cited

U.S. PATENT DOCUMENTS 4,960,216 10/1990 Giles et al. ..... 215/232

4,961,986 10/1990 Galda et al. ..... 428/201

5,004,111 4/1991 McCarthy ..... 215/232

5,433,992 7/1995 Galda et al. ..... 428/201

*Primary Examiner*—Stephen Cronin

*Attorney, Agent, or Firm*—Shenier & O'Connor

[57] ABSTRACT

The present invention relates to a device for opening a receptacle having a peripheral rim on which a capsule is head sealed. The capsule includes a heat-sealable bottom layer and a metal top layer that adheres to the heat-sealable layer. Above the capsule, there is provided a tongue constituted by a metal sheet suitable for completely covering the metal layer of the capsule. The sheet is bonded to the metal layer in a lateral segment by a layer of adhesive material that adheres to the metal layer and to the metal sheet. The capsule is peeled off the receptacle by pulling the tongue upwards.

3 Claims, 1 Drawing Sheet

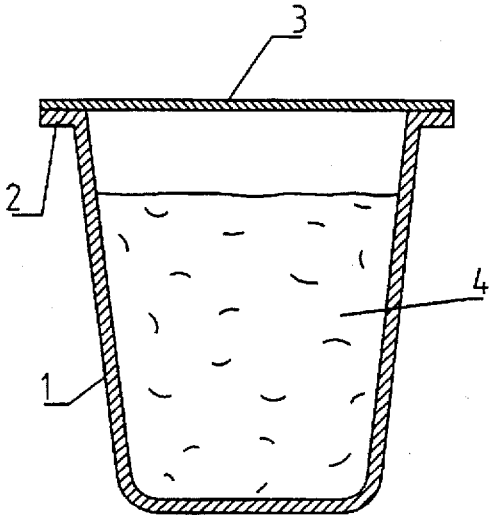
FIG.1
FIG.2
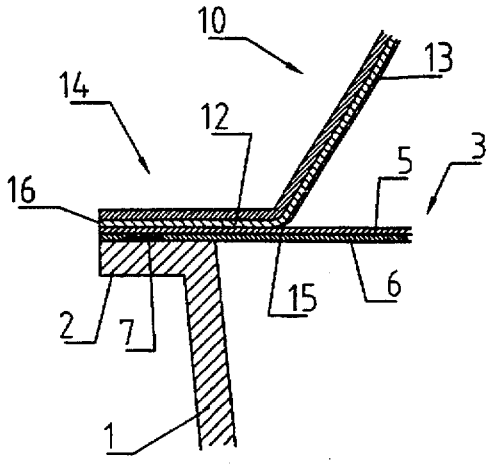
FIG.3
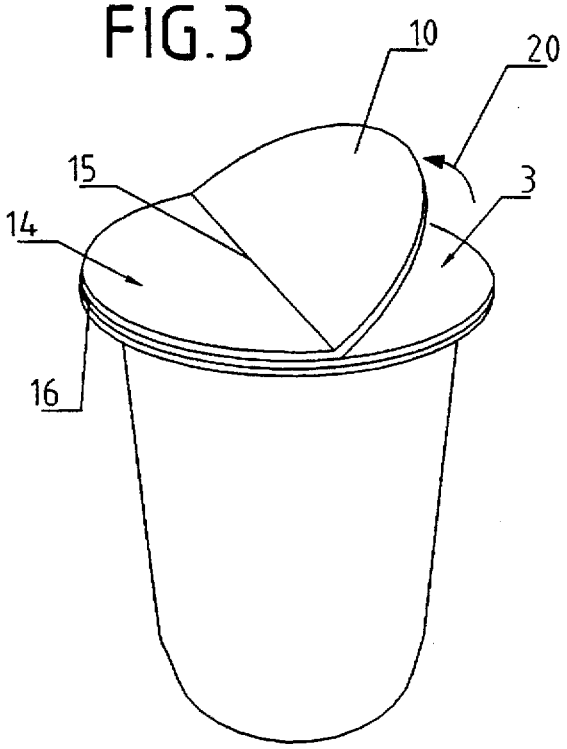
FIG.4
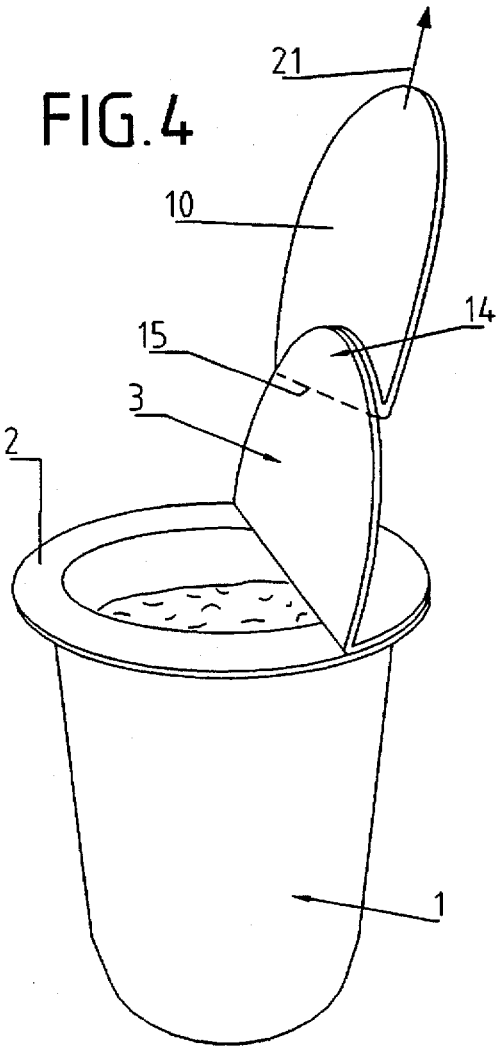

DEVICE FOR OPENING A RECEPTACLE HAVING A RIM CLOSED BY A CAPSULE

The present invention provides a receptacle including a peripheral rim on which a capsule is fixed by thermosealing, said capsule including a heat-sealable bottom layer sealed against the peripheral rim and a metal top layer adhering to the heat-sealable layer, the capsule being peelable off the peripheral rim by exerting manual traction on a tongue of said capsule.

BACKGROUND OF THE INVENTION

This type of receptacle is used, in particular, for containing beverages and other foodstuffs or medicines. The top layer must be strong enough to enable the capsule to be peeled off without tearing and it must be completely impermeable. It is generally made of metal.

In general, the tongue is part of the capsule and it is disposed outside the heat-seal fillet. Its area should be large enough to enable the user to begin peeling off without too much difficulty.

When a single manufacturing line is used to make the receptacles by thermoforming a plastics sheet, to fill them, and to seal them, the capsules and the receptacles are separated together by cutting, using cutting tools installed on the single line. Under such circumstances, the outline of the capsule and the outline of the receptacle rim are superposed. The tongue is then disposed over a portion of the rim which may be separated from the rim proper by a pre-cut line of weakness. This rim portion must separate from the receptacle when traction is exerted on the tongue. In the absence of a line of weakness, the user must separate the tongue from this portion of rim before starting to peel off the capsule.

Nevertheless, in either case, the area of the tongue is small compared with the total area of the capsule, and it can be difficult or even impossible to peel it off, particularly if the capsule is stuck firmly to the rim by the heat sealing.

OBJECT AND SUMMARY OF THE INVENTION

The object of the present invention is to mitigate those drawbacks, by proposing a tongue of large area.

The invention achieves this object by the tongue being constituted by a metal sheet suitable for covering fully the metal layer of the capsule, said metal sheet being connected to the metal layer of the capsule in a lateral segment by means of a layer of adhesive material that adheres to the metal layer and to the metal sheet, and by the adhesive material covering the entire bottom face of the metal sheet, with a varnish that does not adhere to the metal layer and that is not reactivatable on heating being applied to the bottom face of the layer of adhesive material in the zone not including the lateral segment. By way of example, the varnish is a cellulose varnish.

The adhesive material is selected from materials providing strong adhesion. It may in particular be a copolymer of ethylene and acrylic acid.

BRIEF DESCRIPTION OF THE DRAWING

Other advantages and characteristics of the invention appear on reading the following description made by way of non-limiting example and given with reference to the accompanying drawing, in which:

FIG. 1 is a section of a receptacle having a rim sealed by a capsule which is provided with a tongue of the invention;

FIG. 2 shows, on a larger scale, the various layers of the capsule and of the tongue, the tongue being shown lifted off the capsule for reasons of clarity; and FIGS. 3 and 4 show various steps to be performed when opening the receptacle.

MORE DETAILED DESCRIPTION

In the drawings, there can be seen a receptacle 1 having a peripheral rim 2 on which a capsule 3 is sealed by heat sealing.

The receptacle 1 shown in the drawing is in the form of a frustoconical cup containing a liquid 4. The cup may be made by thermoforming a strip of polypropylene, of coated card, or of PVC.

The capsule 3 essentially comprises two layers: a top layer 5 of aluminum; and a heat-sealable bottom layer 6 adhering to the layer of aluminum 5 and bonded to the material constituting the peripheral rim 2 via a heat seal fillet 7.

To enable the receptacle 1 to be opened, a tongue 10 is placed on top of the capsule 3, which tongue is constituted by a sheet of aluminum 11 that covers the layer 5 of aluminum completely and whose outline is exactly the same as the outline of the capsule 2.

On its bottom face, the aluminum sheet 11 has a layer 12 of material that adheres strongly to aluminum, e.g. a copolymer of ethylene and acrylic acid. A layer 13 of varnish that does not adhere to aluminum and that is not reactivatable on being heated is applied under the bottom face of the layer 12. The varnish is applied over the major portion of the area of the layer 13 with the exception of a segment 14 defined by a chord 15 and a portion 16 of the peripheral outline of the layer 12, the chord 15 interconnecting the ends of said portion 16.

In the segment 14, the layer 12 of adhesive material adheres to the layer of aluminum 5. Outside the segment 14, the capsule 3 and the tongue 10 are next to each other but they do not bond together because of the layer of varnish 13.

To open the receptacle 1, the procedure is as follows: the tongue 10 is raised to a vertical position as shown by arrow 20 and then one hand is used to exert an upwardly directed force 21 on the tongue 10 while holding the receptacle 1 in the other hand.

The area of the segment 14 and the adhesive material selected for the layer 12 are determined so that the force 21 causes the receptacle 1 to be opened by the capsule 3 being peeled off and does not cause the tongue 10 to be torn off the capsule 3.

The above-described disposition for the tongue 10 makes it easy to grasp the tongue and easy to open the receptacle 1.

The capsule 3 and the tongue 10 as described above may advantageously be taken from a single strip of composite material that comprises all five superposed layers 6, 5, 13, 12, 11 constituting the capsule 3 and the tongue 10 during the stage of cutting apart the receptacles 1 that have been filled and closed on a line for manufacturing and filling the receptacles.

The layers 5 and 11 of aluminum may naturally be replaced by layers of other materials, in particular polyester or paper, depending on the intended use.

The thickness of the aluminum layers 5 and 11 preferably lies in the range 12 micrometers to 60 micrometers. The density of the layer 12 of ethylene and acrylic acid copolymer is twenty grams per square meter.

I claim:

1. A receptacle including a peripheral rim on which a capsule is fixed by thermosealing, said capsule including a heat-sealable bottom layer sealed against the peripheral rim and a metal top layer adhering to the heat-sealable layer, the capsule being peelable off the peripheral rim by exerting manual traction on a tongue of said capsule, wherein the tongue is constituted by a metal sheet suitable for covering fully the metal layer of the capsule, said metal sheet being connected to the metal layer of the capsule in a lateral segment by means of a layer of adhesive material that adheres to the metal layer and to the metal sheet, and wherein the adhesive material covers the entire bottom face of the metal sheet, with a varnish that does not adhere to the metal layer and that is not reactivatable on heating being applied to the bottom face of the layer of adhesive material in the zone not including the lateral segment.

2. A receptacle according to claim 1, wherein the adhesive material is a copolymer of ethylene and acrylic acid.

3. A receptacle according to claim 1, wherein the varnish is a nitrocellulose varnish.

* * * * *